United States Patent [19]

Czinger

[11] 3,943,852

[45] Mar. 16, 1976

[54] PRINTING SADDLE HAVING SELF-CONTAINED LATCH

[75] Inventor: David B. Czinger, Los Alamitos, Calif.

[73] Assignee: Beach Manufacturing, Inc., Buena Park,, Calif.

[22] Filed: Oct. 23, 1974

[21] Appl. No.: 517,365

[52] U.S. Cl. ..... 101/415.1; 101/378

[51] Int. Cl.[2] ..... B41F 27/06

[58] Field of Search ..... 24/239; 101/415.1, 378

[56] References Cited

UNITED STATES PATENTS

| | | | |
|---|---|---|---|
| 2,216,499 | 10/1940 | Ohotto | 24/239 X |
| 2,550,038 | 4/1951 | Brown | 24/239 X |
| 2,599,660 | 6/1952 | Poutinen | 24/239 |
| 2,825,112 | 3/1958 | Frieder et al. | 24/239 |
| 3,102,708 | 9/1963 | Crain | 24/239 X |
| 3,408,933 | 11/1968 | Hermach et al. | 101/415.1 |
| 3,486,206 | 12/1969 | McCarthy | 24/239 |
| 3,604,069 | 9/1971 | Jenson | 24/239 X |
| 3,605,621 | 9/1971 | Woessner et al. | 101/415.1 |
| 3,625,151 | 12/1971 | Hart | 101/415.1 |
| 3,696,744 | 10/1972 | Etchell | 101/415.1 |
| 3,791,295 | 2/1974 | Albright | 101/415.1 |

*Primary Examiner*—Edgar S. Burr
*Assistant Examiner*—Paul J. Hirsch
*Attorney, Agent, or Firm*—Fulwider, Patton, Rieber, Lee & Utecht

[57] ABSTRACT

A shell defining a semicylindrical printing saddle formed on one longitudinal side with a plate mount for receiving one end of a flexible printing plate having printing indicia thereon and on its opposite longitudinal side with a pair of circumferentially outwardly opening bores having sleeves mounted therein and terminating at their inner extremities in respective axially rearwardly facing stop surfaces. A biasing bar projects coextensive with the saddle adjacent such other side and includes a mount for receiving the opposite end of such printing plate. The biasing bar is formed with through bores confronting the respective cavities and has received therein self-contained latch devices including cylindrically shaped hollow latch housings projecting through such sleeves and into the respective cavities. The housings are each formed with radially outwardly opening latch passages and a pair of latch balls is provided for selective shifting radially outwardly through such passages to engage behind the aforementioned stop surfaces. Axially projecting plungers are received in such housings and selectively engage such latch balls to drive them radially outwardly through such passages to engage behind the respective stop surfaces.

13 Claims, 8 Drawing Figures

FIG. 1
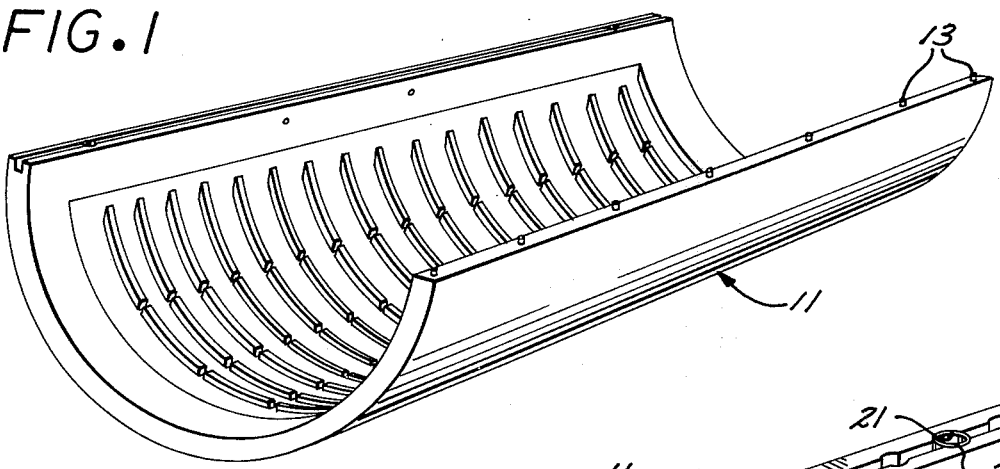
FIG. 2
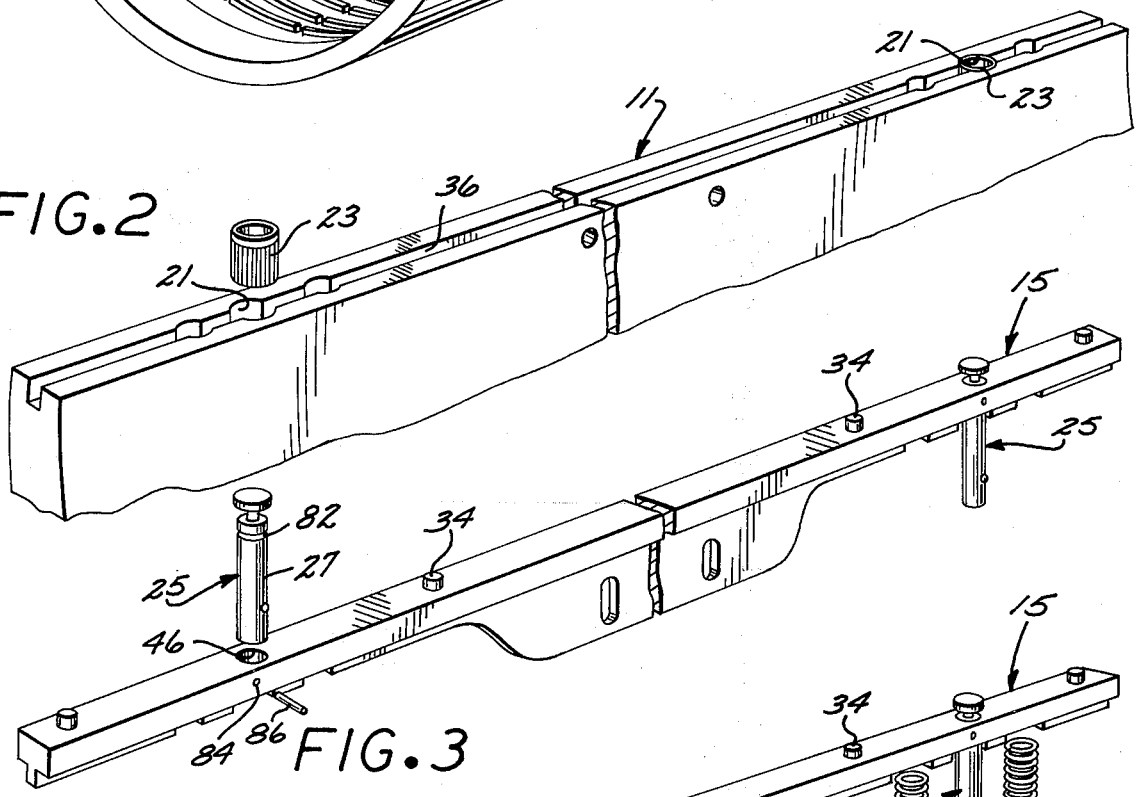
FIG. 3
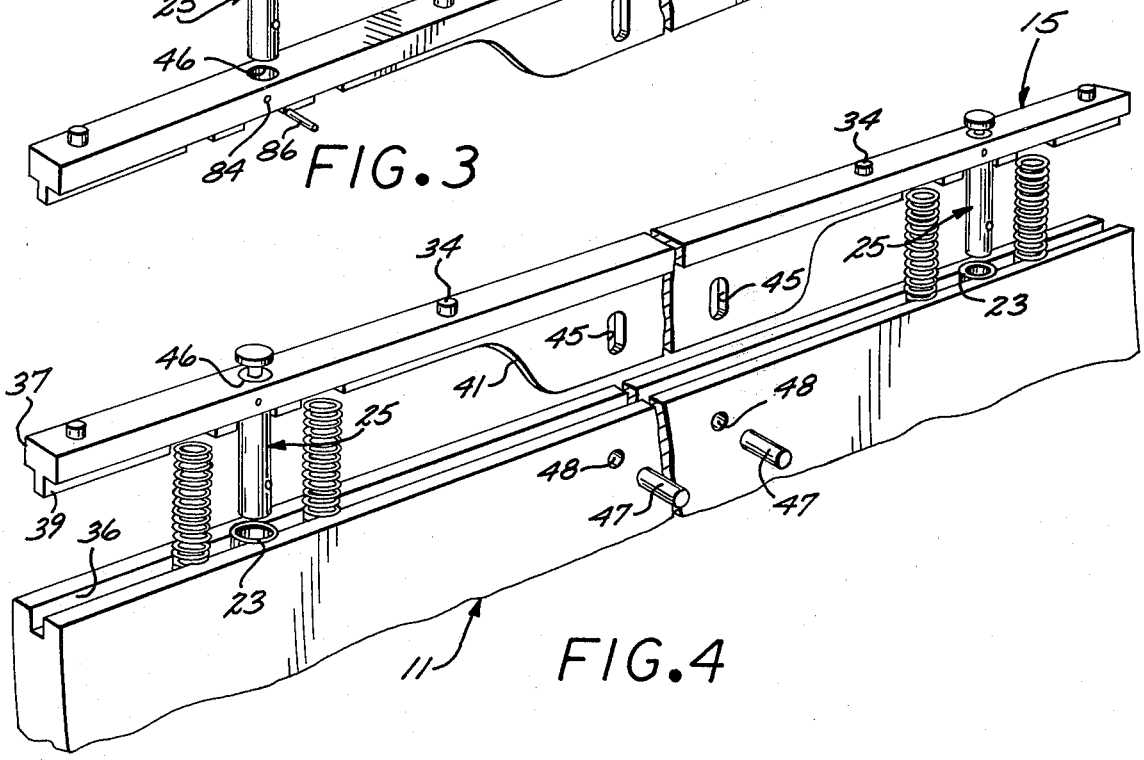
FIG. 4

FIG. 5
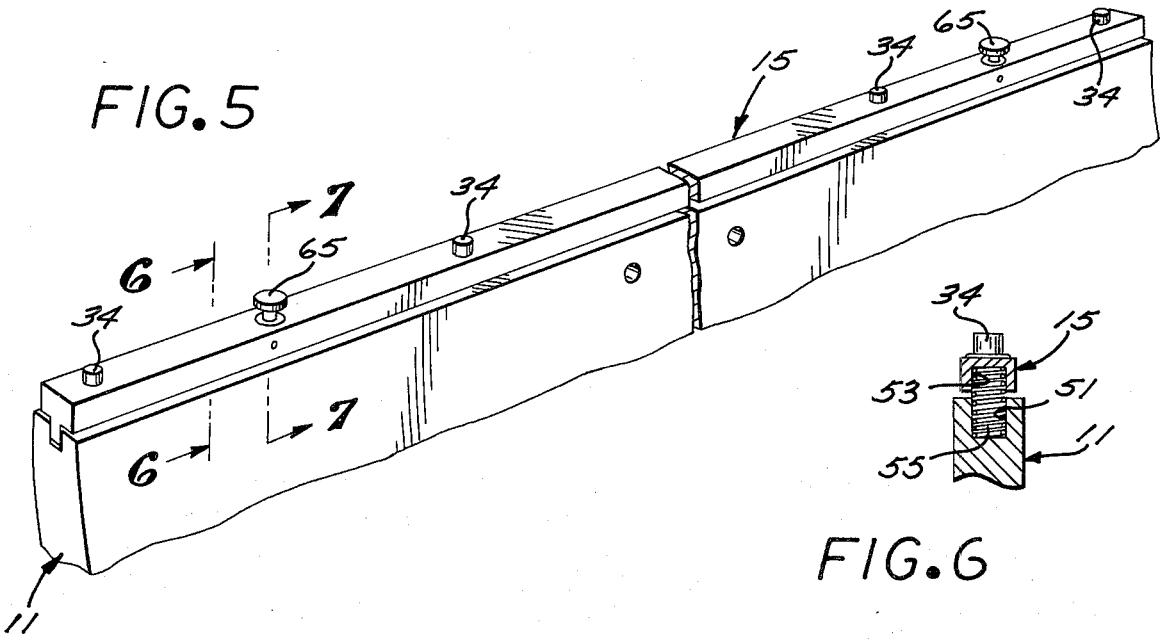
FIG. 6
FIG. 7
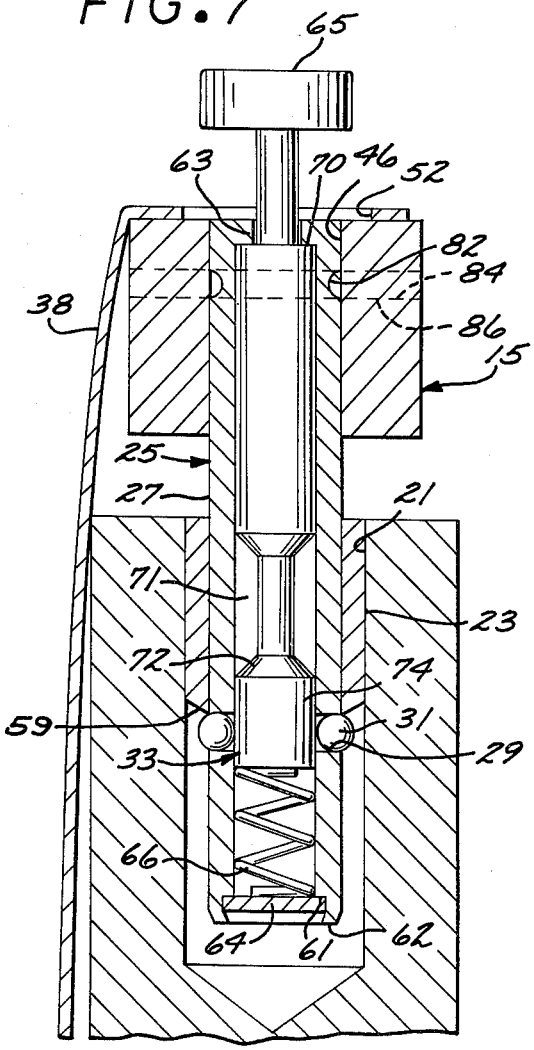
FIG. 8
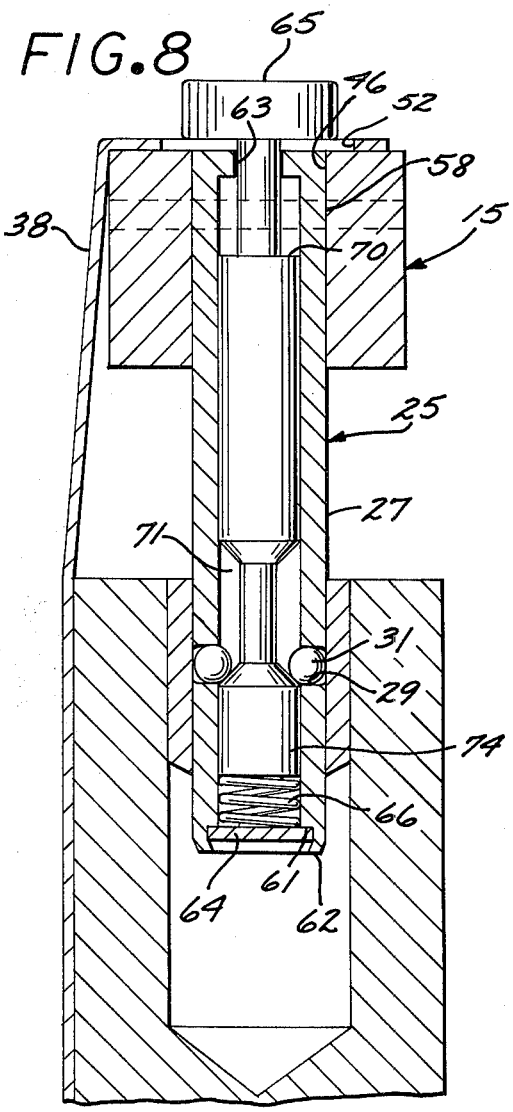

PRINTING SADDLE HAVING SELF-CONTAINED LATCH

BACKGROUND OF THE INVENTION

1. Field of the Invention

The present invention relates to a saddle which is mounted on a printing drum for receipt thereon of a flexible printing plate on which indicia to be printed is formed.

2. Description of the Prior Art

In the printing industry, it has been common practice to employ a large number of rotary printing presses having rotary printing cylinders which have semicylindrical saddle shells mounted on the opposite sides thereof for receiving respective relatively thin photoengraved plates on which the material to be printed has been formed. The many different arrangements have been proposed for removably mounting such printing plates on the saddles in a rapid and efficient manner. One such arrangement contemplates providing mounting pegs along one side of the saddle for receipt thereover of bores formed in one end of the printing plate and then providing a biasing bar along the opposite side of such saddle which is biased outwardly away from the saddle. Such biasing bar also employs pegs over which bores formed in the opposite end of the printing plate may be received to then enable such biasing bars to be retracted so the printing plate may be mounted on one end on the saddle and on the opposite end on such bar and the bar then released to bias the plate to a tensioned condition about the saddle. This arrangement suffers the shortcoming that mounting of the printing plate on the saddle is relatively difficult and time consuming, requiring the drum to be advanced three different times during mounting of the printing plate and four different times for dismounting thereof.

Various devices have been proposed for locking such biasing bar in a retracted position during mounting and dismounting of the printing plate to thus expedite such mounting and dismounting procedure. A device of this type is shown in U.S. Pat. No. 3,696,744. However, all such locks known to applicant suffer the shortcoming that they are constructed of several different components which require individual assembly in the saddle and bar, thus consuming considerable time and rendering the saddle itself prohibitively expensive to manufacture.

SUMMARY OF THE INVENTION

The printing saddle of the present invention is characterized by a self-contained latch carried in the biasing bar of a saddle shell and projectable through a sleeve mounted in a cavity in the adjacent edge of the shell and including an actuator operable to engage a latch element behind the interior end of such shell to latch the bar in its retracted position. The actuator may be selectively released to retract such latch element from its latching position to thus free the biasing bar to assume its tensioning position maintaining the printing plate in tension about the saddle.

BRIEF DESCRIPTION OF THE DRAWINGS

FIG. 1 is a perspective view of a printing press saddle embodying the present invention;

FIG. 2 is a broken perspective view, in enlarged scale, of one edge of the printing press saddle shown in FIG. 1;

FIG. 3 is a broken perspective view, in enlarged scale, of a biasing bar utilized with the printing press saddle shown in FIG. 1;

FIG. 4 is a broken perspective view showing the biasing bar in the printing press shown in FIG. 3 being assembled together;

FIG. 5 is a broken perspective view depicting the printing press saddle and biasing bar shown in FIG. 4 assembled together;

FIG. 6 is a vertical sectional view taken along the line 6—6 of FIG. 5;

FIG. 7 is a vertical sectional view, in enlarged scale, taken along the line 7—7 of FIG. 5, and showing the biasing bar in its retracted position; and FIG. 8 is a vertical sectional view, similar to FIG. 7, but showing the biasing bar in its released position.

DESCRIPTION OF THE PREFERRED EMBODIMENT

The printing press saddle of the present invention includes, generally, a semicylindrical shell 11 (FIG. 1) having circumferentially projecting mounting pins 13 along one axial side thereof and a biasing bar 15 (FIG. 5) disposed axially along the opposite side thereof. Referring to FIGS. 2, 4 and 7, the side of the shell 11 adjacent the biasing bar 15 is formed with a pair of outwardly opening bores 21 defining cavities in which tubular stop sleeves 23 are press fit. As shown in FIGS. 3 and 7, the bar 15 has self-contained latches, generally designated 25, mounted therein and formed with barrels 27 received telescopically in the sleeves 23 and formed on their inner extremities with radially outwardly opening conically shaped passages 29 through which latching balls 31 are selectively shifted radially by means of a plunger actuator, generally designated 33, to selectively engage such balls behind the inner end of the sleeve 23 to selectively lock the biasing bar 15 in the retracted position shown in FIG. 7. Mounting pins 34 are spaced along the bar 15 to cooperate with the pins 13 in mounting a flexible printing plate 38 from the saddle shell 11.

The shell 11 is preferably of aluminum construction and has the individual bores 21 (FIG. 2) drilled in the one edge thereof proximate the respective axial opposite ends of such shell and such edge is further formed with a longitudinally extending slot 36 for receipt of the biasing bar 15.

The biasing bar 15 preferably projects the full length of the shell 11 and is formed with a longitudinally extending square-in-cross-section head 37 (FIG. 4) having a thin web 39 projecting circumferentially therefrom to be received slidably in the slot 36. Such web 39 is cut back at 41 proximate the respective latches 25, and if formed with a pair of transversely elongated slots 45 for receipt of roll pins 47 which are inserted in bores or holes 48 formed in the shell 11 to project through such slots 45 to limit and guide circumferential travel of the bar 15. Referring to FIG. 3, respective bores 46 are formed proximate the opposite extremities of such bar 15 in alignment with the stop sleeves 23 for press fit receipt of the latches 25. As shown in FIGS. 2 and 4, two pair of bores 51 are formed in the shell 11 on opposite sides of the respective latches 25 for receipt of the respective one extremities of biasing springs 55 and confronting bores 53 are formed in the biasing bar 15 for receipt within such respective bores of the opposite extremities of such biasing springs.

Referring to FIGS. 7 and 8, each latch 25 is self-contained and includes a cylindrical tubular housing defining the telescopical barrel 27 on one extremity and a tubular receiver 58 on the opposite extremity thereof for receipt in the bore 46. The radial latch bores 29 are formed medially in the individual tubular barrel 27 with the walls on the sides thereof which face axially inwardly with respect to such barrels defining abutment surfaces for engaging the peripheries of the individual latching balls to trap such balls against the stop surfaces defined by axially inner ends 59 of the cylindrical stop sleeves 41. The interior of such barrel is enlarged-in-cross section at the inner extremity thereof to form an annular shoulder 61 having a peripheral skirt 62 projecting axially therefrom. A flat plate 64 is received within the skirt 62 and such skirt is swaged radially inwardly thereabout to secure such plate in position. A coil spring 66 is sandwiched between such plate 62 and the proximate end of the plunger 33 to urge such plunger to its extended position. The opposite end of the barrel 27 is formed with an in-turned rim 63 which acts as a stop to hold the plunger 33 captive. The plunger 33 is necked down at its outer extremity to form an annular shoulder 70 to abut against the rim 63 and then projects through the opening defined by the rim 63 and is then formed with a relatively large diameter button 65 on its outer extremity.

The plunger 33 is formed medially with a reduced-in-diameter spool 71 which tapers conically outwardly at its opposite extremities to the full diameter of such plunger, the axially inner conical end of such spool defining a tapered actuating cone 72. The plunger 33 projects axially inwardly beyond the spool 71 to form a cylindrical holding tip 74 registerable with the ball passages 29 to hold the balls 31 in their radially extended positions shown in FIG. 7. Referring to FIGS. 3 and 7, it is important that the ball-receiving passages are conically shaped taper inwardly as they extend radially outwardly to terminate in a retaining aperture having a diameter slightly smaller than the diameter of the balls 31 to thereby hold such balls 31 captive during assembly of the latches 25 in the bar 15 while allowing the peripheries of such balls to project therefrom to lock against the end 59 of the stop sleeves 23 as shown in FIG. 7 when the latch 25 is in its latching position.

Referring to FIGS. 3 and 7, the barrel 27 is formed at its outer extremity with a circumferential groove 82 which aligns with a transverse bore 84 formed in the bar 15. A roll pin 86 projects through the bore 84 with the intermediate portion thereof being received in the groove 82 to lock the barrel 27 in place on such bar.

From the foregoing, it will be apparent that during fabrication of the saddle of the present invention, the stop sleeves 23 may be easily press fit into the respective receiving bores 21 (FIG. 2) and the latches 25 may likewise be conveniently press fit into their bores 46 in the biasing bar 15 and locked in position by the locking pins 86. Referring to FIG. 4, the biasing springs 55 may then have their respective one extremities inserted in the respective bores 51 on the shell 11 and the biasing bar 15 then brought into position with the web 39 (FIG. 4) slidably received in the receiving slot 36. Concurrently, the respective latch barrels 27 will be freely telescoped through the sleeves 23 and the projecting extremities of the springs 55 received in the respective biasing bores 53. The roll pins 46 may then be inserted through their receiving bores 48 in the shell 11 and through the respective slots 45 in the web 39 to thus retain the biasing bar 15 captive on the saddle. Thus, the biasing bar 15 is easily installed on the saddle in three quick steps, thus contributing immensely to the efficiency of manufacture.

In operation, a flexible printing plate 38 may conveniently have the bores formed on one end thereof received over the pins 13 (FIG. 1) projecting from the side of the shell 11 remote from the bar 15, and the remainder of the plate 38 then wrapped about the outer periphery of the shell 11. With the biasing bar 15 depressed and locked in the retracted position shown in FIG. 7, the trailing end of such plate may then have the bores therein received over the pins 34 projecting from such bar 15, it being appreciated that such plate is also formed with openings 52 (FIG. 7) for passage of the latch buttons 65. The latch buttons 65 may then be depressed to shift the spools 71 axially inwardly within the barrel 27 to the position shown in FIG. 8 to shift the holding tip 74 out of alignment with the latching balls 31 and register such spools 71 with such balls to free such latching balls to move radially inwardly to the position shown in FIG. 8. The bar 15 will then be urged circumferentially outwardly under the influence of the springs 55 (FIG. 6) to the position shown in FIG. 8, thus applying tension to the printing plate 38 to maintain such plate tensioned about the shell 11. When both saddles on a particular drum are loaded in this manner, the drum is ready for rotation and consequent printing of the indicia formed on the printing plate.

From the foregoing, it will be apparent that the printing saddle of the present invention is relatively convenient and economical to manufacture and provides a convenient and effective means for mounting a printing plate on a rotary printing saddle.

Obviously, many modifications and variations of the present invention may be made with regard to the foregoing detailed description without departing from the spirit of the invention.

What is claimed is:

1. A saddle for mounting a flexible printing plate from a cylindrical drum comprising:

a longitudinally extending semicylindrical saddle shell formed on one longitudinal side with a plate mounting device for receiving one end of said plate and on its opposite longitudinal side with at least one outwardly opening cavity;

a sleeve mounted in said cavity and defining a stop surface facing inwardly of said cavity;

an elongated biasing bar projecting axially along said opposite side of said saddle and including printing plate fastening means for receiving the end of the said plate opposite said one end, said bar being shiftable from an extended to a retracted position and being formed with a bore confronting said cavity;

biasing means biasing said bar away from said saddle;

limit means limiting travel of said bar away from said saddle;

a self-contained latch formed at one extremity with a tubular housing received in said bore and terminating in an open end, said latch being further formed with a barrel projecting axially from said bore for free telescopical receipt in said sleeve and having at least one transversely extending passage means aligned behind said stop surface when said bar is in its retracted position, said housing still further including first abutment means adjacent said passage means and facing said open end;

latching element means disposed in said barrel for shifting transversely through said passage means to a latching position engaged behind said stop surface;

retaining means in said barrel for retaining said latching element from escape transversely outwardly from said passage means;

said latch further including a plunger received in said housing and operative upon axial shifting thereof in said sleeve to a first axial position to urge said latching element transversely outwardly in said passage means to said latching position and upon shifting of said plunger to a second axial position to release said latching element for retraction from said latching position to release said housing from said stop surface for axial sliding relative thereto; and a spring contained in said latch to bias said plunger to said second position whereby upon assembly said entire self-contained latch may be inserted in said bore as a unit.

2. A saddle according to claim 1 wherein:

said barrel includes a skirt projecting axially inwardly beyond the axially inner end of said plunger, plate means covering the end of said skirt and said spring is in the form of a coil compression spring interposed between said plate means and the adjacent end of said plunger.

3. A saddle according to claim 1 wherein:

said plunger includes an actuator button projecting from said open end of said housing and is formed on the inner extremity thereof with a radially projecting peripheral flange and said housing is formed at said open end with a radially in-turned rim overlying said flange for abutment thereby to limit axially outward travel of said plunger.

4. A saddle according to claim 1 wherein:

said passage means includes a pair of oppositely disposed passages and said latching element means includes a pair of latching balls for travel in said respective passages and wherein, further, said plunger is formed with an annular groove for receipt of said balls when said plunger is in said second position and an enlarged-in-cross-section holding tip registered with said passages when said plunger is in said first position.

5. A saddle according to claim 1 wherein:

said sleeve is tubular shaped and is sized for being press fit into said cavity.

6. A saddle according to claim 1 wherein:

said saddle is formed in said opposite side with an axially projecting circumferentially outwardly opening slot; and said bar is formed with a guide web received slidably in said slot.

7. A saddle according to claim 1 wherein:

said latching element is in the form of a sphere; and said transverse passage means tapers transversely outwardly and inwardly to terminate in an exterior end having a smaller cross section than said latching element to retain said latching element captive against escape from said exterior end.

8. A saddle according to claim 6 wherein:

said limit means includes a pair of spaced apart holes formed in said saddle and projecting across said slot and further includes a pair of circumferentially projecting slots formed in said web in alignment with said respective holes, said limit means further including limit pins inserted through said holes and respective slots.

9. A saddle according to claim 1 wherein:

said receiver is formed in its periphery with a transversely extending groove and said biasing bar is formed with a transverse bore aligned with said groove and said latch further includes a holding pin frictionally received in said transverse bore and engaged with said groove to secure said latch housing in position.

10. A saddle according to claim 1 wherein:

said plunger is necked down adjacent said one end to form an axially projecting neck and is then enlarged-in-cross-section to form a shoulder facing said open end and said latch housing is formed at said open end with an inturned rim encompassing said neck and engagable by said shoulder to hold said plunger captive in said housing.

11. A saddle for mounting a flexible printing plate from a cylindrical drum as set forth in claim 1 wherein:

said latch element is in the form of a latching ball having a diameter greater than said predetermined diameter.

12. A saddle for mounting a flexible printing plate from a cylindrical drum, comprising:

a semicylindrical saddle shell formed on one side with a plate mounting device for receiving one end of said plate on its opposite side with at least one outwardly opening cavity;

a sleeve mounted in said cavity and defining a stop surface facing inwardly of said cavity;

an elongated biasing bar projecting axially along said opposite side of said saddle and including printing plate fastening means for receiving the end of said plate opposite said one end, said bar being shiftable from an extended to a retracted position and being formed with a bore confronting said cavity;

biasing means biasing said bar away from said saddle;

limit means limiting travel of said bar away from said saddle; and a self-contained latch including an elongated tubular housing formed on one extremity with a receiver received in said bore and being open on the one end and formed in its extremity opposite said one extremity with a transversely outwardly projecting and radially inwardly converging conical latch passage terminating at its outer extremity in a reduced-in-cross section aperture having a predetermined diameter, a latch element disposed in said housing for projection radially outwardly through said passage to engage said stop surface and having a cross section of sufficient size to be restricted from escape outwardly through said aperture, said latch further including an axially with respect to said housing projecting actuator in said housing and engaged on one extremity with said latch element and projecting on its opposite extremity from said open end, said actuator being operative upon actuation thereof to drive said latch element outwardly in said passage to engage with said stop surface and upon deactuation thereof to free said latch element for travel transversely

13. A saddle for mounting a flexible printing plate from a cylindrical drum as set forth in claim 12 wherein:

said plunger is necked down adjacent said one end to form an axially projecting neck and is then enlarged-in-cross section to form a shoulder facing said open end and said latch housing is formed at said open end with an inturned rim encompassing said neck and engagable by said shoulder to hold said plunger captive in said housing.

* * * * *